US009233383B2

(12) United States Patent
De Rosa

(10) Patent No.: US 9,233,383 B2
(45) Date of Patent: Jan. 12, 2016

(54) PACKAGING AND DISPENSING DEVICE COMPRISING A CLEARANCE COMPENSATION COVER

(71) Applicant: Daniel De Rosa, Louviers (FR)

(72) Inventor: Daniel De Rosa, Louviers (FR)

(73) Assignee: MAITRISE & INNOVATION, Val de Reuil (FR)

( * ) Notice: Subject to any disclaimer, the term of this patent is extended or adjusted under 35 U.S.C. 154(b) by 0 days.

(21) Appl. No.: 14/514,441

(22) Filed: Oct. 15, 2014

(65) Prior Publication Data

US 2015/0102069 A1 Apr. 16, 2015

(30) Foreign Application Priority Data

Oct. 16, 2013 (FR) ..... 13 60050

(51) Int. Cl.

| | |
|---|---|
| ***B05B 11/00*** | (2006.01) |
| ***B65D 83/40*** | (2006.01) |
| *B65D 55/02* | (2006.01) |
| *B65D 83/20* | (2006.01) |

(52) U.S. Cl.

CPC ..... *B05B 11/0027* (2013.01); *B05B 11/0032* (2013.01); *B65D 83/40* (2013.01); *B05B 11/00* (2013.01); *B05B 11/3047* (2013.01); *B05B 11/3049* (2013.01); *B65D 55/02* (2013.01); *B65D 55/022* (2013.01); *B65D 83/205* (2013.01); *B65D 2255/20* (2013.01)

(58) Field of Classification Search

CPC B05B 11/00; B05B 11/3047; B05B 11/0027; B05B 11/0032; B05B 11/3049; B05D 83/40; B05D 83/205; B05D 2255/20; B05D 55/02; B05D 55/022

USPC ..... 222/321.1, 321.7, 321.9, 182, 562, 222/153.1

See application file for complete search history.

(56) References Cited

U.S. PATENT DOCUMENTS

| | | | | |
|---|---|---|---|---|
| 3,526,343 | A * | 9/1970 | O'Donnell | 222/182 |
| 5,492,248 | A * | 2/1996 | Ortner | 222/78 |

(Continued)

FOREIGN PATENT DOCUMENTS

| | | |
|---|---|---|
| EP | 1442998 | 8/2004 |
| EP | 1974829 | 10/2008 |
| FR | 2758311 | 7/1998 |

OTHER PUBLICATIONS

French Search Report dated Apr. 30, 2014, corresponding to the Foreign Priority Application No. 1360050.

*Primary Examiner* — Frederick C Nicolas
(74) *Attorney, Agent, or Firm* — Young & Thompson

(57) ABSTRACT

A device (10) for packaging and dispensing a liquid or semi-liquid product, includes a substantially axial reservoir (12) having a transverse upper wall (14) provided with a neck (16) which receives a product release member (18) and an actuating element (20) for the release member (18), a cover (22) which is received on the neck (16) and which caps the release member (18) and the upper wall (14), characterized in that the cover (22) includes at least one first inner member (24) which is adapted to be axially and removably received on the neck (16) in a given axial position, and a second outer member (26) having a peripheral wall (58) which is fitted onto the first member (24) via a clearance compensation fastening element (27) for allowing the adjustment of the cover (22) with the transverse face (14) of the reservoir (12) with a reduced clearance (J).

9 Claims, 2 Drawing Sheets

(56) References Cited

U.S. PATENT DOCUMENTS

| | | | | |
|---|---|---|---|---|
| 5,918,778 | A * | 7/1999 | Schultz | 222/321.7 |
| 6,290,103 | B1 * | 9/2001 | Fraillon | 222/321.1 |
| 6,367,641 | B1 | 4/2002 | Garcia et al. | |
| 6,382,450 | B1 * | 5/2002 | De Rosa et al. | 220/230 |
| 7,874,465 | B2 * | 1/2011 | Bertin et al. | 222/402.12 |
| 8,152,026 | B2 * | 4/2012 | Ki | 222/153.13 |
| 2008/0237264 | A1 | 10/2008 | Auerbach et al. | |
| 2010/0012681 | A1 * | 1/2010 | Drugeon et al. | 222/321.1 |

* cited by examiner

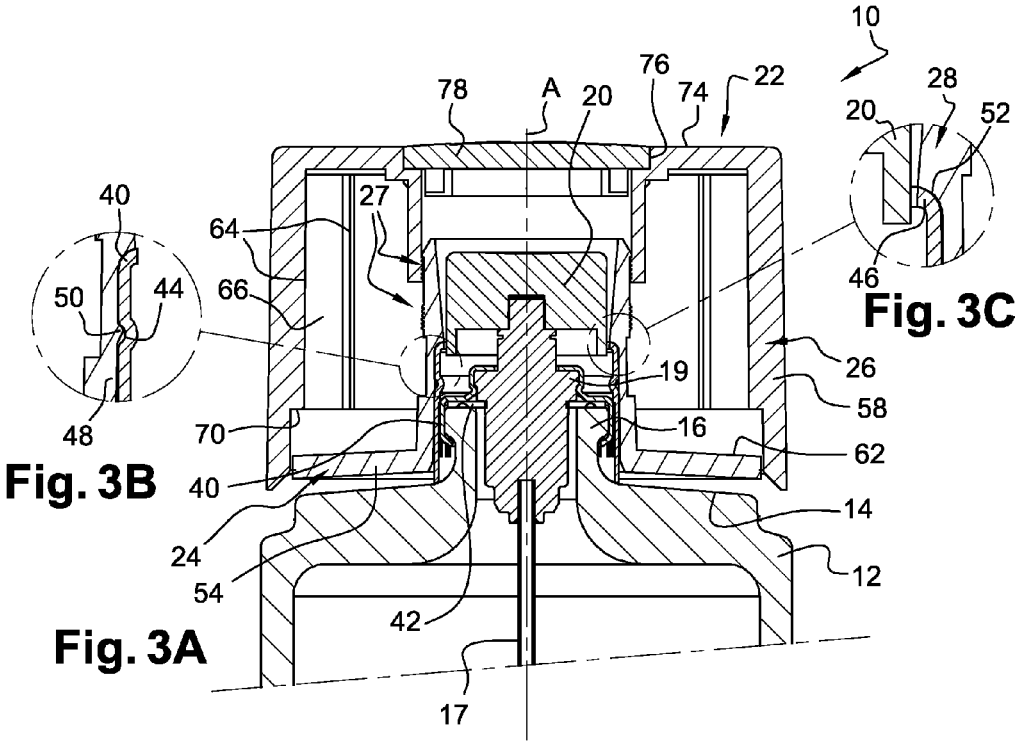
Fig. 3A
Fig. 3B
Fig. 3C
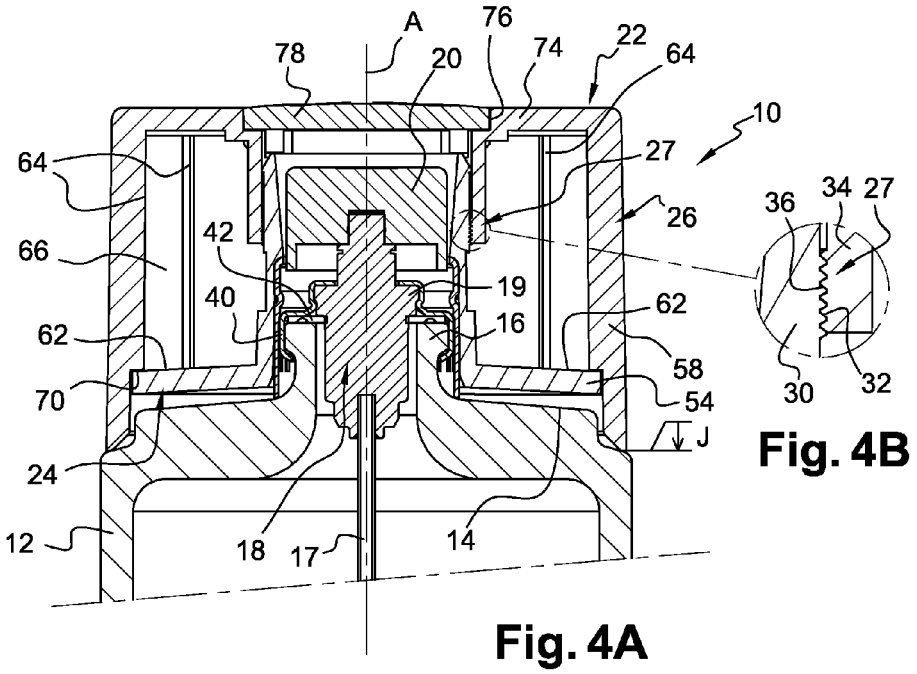
Fig. 4A
Fig. 4B

PACKAGING AND DISPENSING DEVICE COMPRISING A CLEARANCE COMPENSATION COVER

CROSS REFERENCE TO RELATED APPLICATIONS

Applicant claims priority under 35 U.S.C. 119 of French patent application no. 1360050 filed on Oct. 16, 2013.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BRIEF SUMMARY OF THE INVENTION

The invention relates to a device for packaging and dispensing a liquid or semi-liquid product.

The invention relates more particularly to a device for packaging and dispensing a liquid or semi-liquid product, comprising a substantially axial reservoir comprising a substantially transverse and horizontal upper wall provided with a neck which receives a release member, especially a pump exiting from said reservoir, and an actuating means overlying the release member which is adapted to be acted upon to eject a quantity of said product out from said reservoir through said actuating means, said device comprising a cover which is received on the neck and which caps the release member and the upper wall.

Many examples of packaging devices of this type are known.

This is the case for example for perfume bottles comprising a rigid reservoir, in particular of metal or glass, the neck of which receives an axially actuated mechanical pump forming the release member, operated by a push button. When the bottle is not used, a cover may be fitted onto the neck and onto a portion of the pump body protruding from the neck to protect the pump and the push button.

In such a device, the axial position of the cover is conventionally dependent on its fitting onto the neck and onto the portion of the pump body protruding from the neck. Therefore, the position of the cover with respect to the substantially transverse and horizontal upper wall of the bottle is determined by the relative position of the cover with respect to the neck and the portion of the pump body protruding from the neck.

Since this position is established more or less precisely when fitting these elements, it results in a great inaccuracy of positioning the cover with respect to the substantially transverse and horizontal upper wall of the bottle.

This inaccuracy is all the greater as the position with respect to the bottle of the pump body, which is a reference frame of the fitting between the cover and the bottle, is subject to positioning inaccuracies.

Thus, a large clearance may remain between the cover and the substantially transverse and horizontal upper wall of the bottle. This clearance, besides being unsightly, may allow the penetration of foreign bodies between the cover and the upper wall of the bottle.

The invention overcomes this disadvantage by providing a cover made of two inner and outer portions, a clearance compensation means being interposed between said portions for allowing, upon an initial mounting of the outer portion onto the inner portion, the adjustment of the cover with the transverse face of the reservoir with a reduced clearance.

For this purpose, the invention provides a device for packaging and dispensing a liquid or semi-liquid product of the type described above, characterized in that the cover comprises at least a first inner member which is adapted to be axially and removably received on the neck in a given axial position, and a second outer member comprising a peripheral wall which is fitted onto said first member via a clearance compensation fastening means for allowing, upon an initial mounting of the second outer member onto the first inner member, the adjustment of the cover with the transverse face of the reservoir with a reduced clearance.

According to other features of the invention:

- the first member comprises at least one upper tubular section coaxial with the neck, a first bearing surface of which comprises a series of teeth axially spaced apart according to a given pitch and the second member comprises at least one lower inner section complementary to the upper tubular section of the first member, which comprises a second bearing surface comprising a series of teeth axially spaced apart according to the given pitch which are complementary to the teeth of the first bearing surface and are adapted to deform to allow the descent of the lower inner section of the second member on the upper tubular section of the first member and the mutual engagement of the teeth of said first and second bearing surfaces as the second member is axially acted upon to fit onto the first member,
- the teeth of the first and second bearing surfaces are inner and outer bearing surfaces of the first and second members, respectively, and each series is a series of annular teeth which is distributed over the entire periphery of the associated bearing surface,
- the device comprises a tubular intermediate member for wrapping the neck and the release member which is fixed onto the release member, which is received in axial abutment on the substantially transverse and horizontal upper wall, and which is adapted to receive the first inner member in the given axial position,
- the tubular intermediate member for wrapping the neck comprises at least one outer annular groove and an abutment transverse annular face, formed in particular at the end of said intermediate member,
- the first inner member comprises at least one lower tubular section coaxial with the neck which comprises at least one inner lug and/or an angular sector of an inner annular bead adapted to be fitted into the outer annular groove of the intermediate member and at least one shoulder inner annular face adapted to be received in abutment on the abutment transverse annular face of the first intermediate member,
- the first inner member comprises a transverse wall transversely extending from a lower end of the lower tubular section of said first inner member to the peripheral wall of the second outer member and the upper face of which forms a stop for at least one axial member which extends radially and inwardly from an inner face of the peripheral wall of the second outer member, the inner face of the peripheral wall of the first outer member comprises a plurality of axial ribs which are angularly distributed in a regular manner over the entire periphery of the inner face of the peripheral wall of the second outer member, each rib comprises an abutment lower face, the axial position of which allows, as it is received in abutment on the upper face of the transverse wall of the first member, to transmit to the second member an axial force reinforcing the engagement of the teeth of the first and second bearing surfaces of the first and second members, a ballast member is radially interposed between the lower tubular section of said first inner member and the peripheral wall of the second outer member, an upper wall of the second outer member comprises at least one hole adapted to receive by fitting an insert complementary to said hole.

BRIEF DESCRIPTION OF THE SEVERAL VIEWS OF THE DRAWING

Other features and advantages of the invention will appear upon reading the following detailed description for the understanding of which reference is made to the accompanying drawings in which:

FIGS. 3A to 3C are overall and detailed sectional views illustrating a second initial step for assembling the cover according to the invention onto the reservoir, FIGS. 4A and 4B are overall and detailed sectional views illustrating a third final step for assembling the cover according to the invention onto the reservoir.

DETAILED DESCRIPTION OF THE INVENTION

Figure 1:
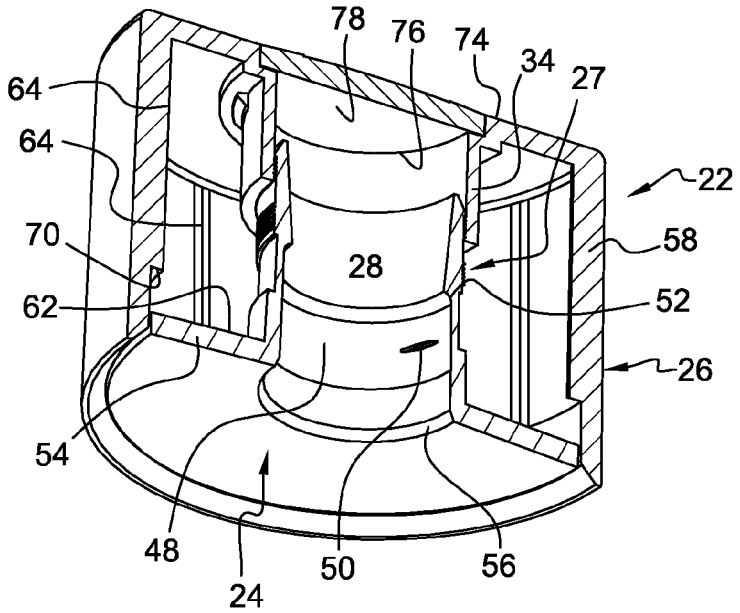
FIG. 1 is a broken perspective view of a cover according to the invention.

In the following description, identical reference numerals designate identical parts or parts having similar functions.

In FIG. 4A is shown a device 10 for packaging and dispensing a liquid or semi-liquid product.

In a known manner, the device 10 comprises a substantially axial reservoir 12, for example and in a manner not limiting the invention, a glass bottle 12, comprising a substantially transverse and horizontal upper wall 14 provided with a neck 16 which receives a product release member 18.

The release member 18 can be made in different configurations, without this limiting the invention. It may be a simple hole or a more complex assembly.

In FIGS. 2 to 4A, for example, is shown a release member consisting of an axially actuated mechanical pump 18, a tube 17 of which dips into the reservoir and a body 19 of which exits from the reservoir 12.

The device 10 comprises an actuating means 20, for example a push button 20, overlying the release member 18 which can be acted upon to eject a quantity of said product out from said reservoir 12 through said actuating means 20.

The device 10 also comprises, in a known manner, a cover 22 which is received on the neck 16 and which caps the release member 18 and the upper wall 14.

In such a device, as known from the prior art, the cover 22 is conventionally in one piece and as such, its axial position with respect to the transverse upper wall 14 of the reservoir 12 depends on its fitting onto the neck 16, and in particular on the relative position of the cover 22 with respect to the neck 16 and/or to the portion of the release member 18, here the body 19 of the pump 18, which protrudes from the neck 16.

Thus, a large clearance (not shown) may remain between the cover 22 and the substantially transverse and horizontal upper wall 14 of the bottle 12 forming the reservoir. This clearance is, on the one hand, unsightly, and, on the other hand, it may allow the penetration of foreign bodies between the cover 22 and the upper wall 14 of the reservoir 12.

The invention overcomes this disadvantage by providing a cover 22 made in two portions between which are interposed clearance compensation means which can be implemented during the assembly of the cover 22, and allowing to minimize the clearance between the cover 22 and the upper wall 14 of the reservoir 12.

For this purpose, the invention provides a device 10 of the type described above, characterized in that the cover 22 comprises at least a first inner member 24 which is adapted to be axially and removably received on the neck 16 in a given axial position, and a second outer member 26, comprising a peripheral wall 58, which is fitted onto said first member 24 via a clearance compensation fastening means 27.

This configuration allows, as shown in FIGS. 2 to 4A, during the different assembly steps, the adjustment of the cover 22, and more particularly of the second outer member 26 with the upper wall 14 of the reservoir 12 with a clearance "J" as reduced as possible, as shown in FIG. 4.

Figure 2:
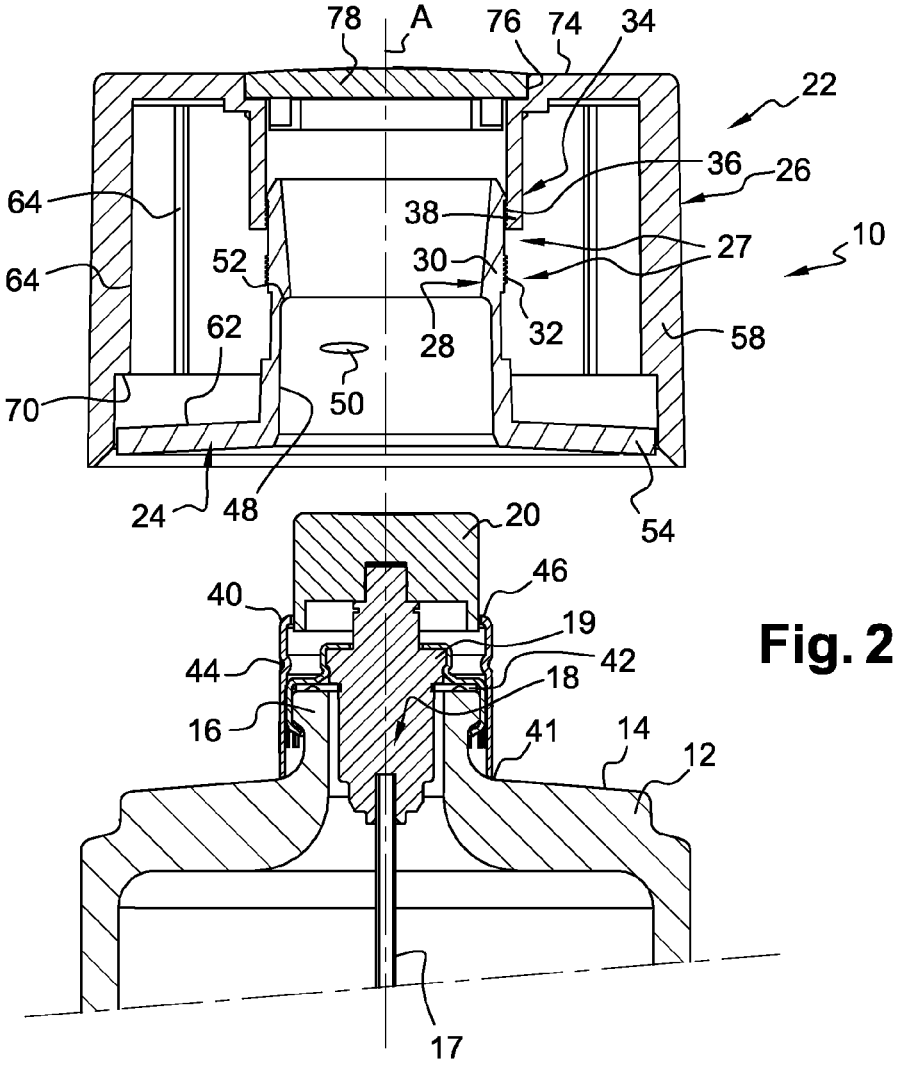
FIG. 2 is an overall sectional view illustrating a first step for positioning a cover according to the invention over a reservoir.

More particularly, as illustrated by FIGS. 2 and 4B, the first member 24 comprises at least one upper tubular section 28 coaxial with the neck 16, a first bearing surface 30 of which comprises a series of teeth 32 axially spaced apart according to a given pitch. The selected pitch is for example in the order of 0.3 mm.

The second member 26 comprises at least one lower section 34, complementary to the upper tubular section 28 of the first member 24, which comprises a second bearing surface 36 comprising a series of teeth 38 axially spaced apart according to the same given pitch and which are complementary to the teeth 32 of the first bearing surface 30.

The teeth 38 are adapted to deform to allow the descent of the lower inner section 34 of the second member 26 along the upper tubular section 28 of the first member 24. The descent causes the mutual engagement of the teeth 32, 38 of said first and second bearing surfaces 30, 32 as the second member 26 is axially acted upon to fit onto the first member 24, as shown in FIG. 4A.

The clearance compensation fastening means 27 is thus called a rack fastening means.

The clearance compensation fastening means 27 may take many forms.

For example, the first member 24 may comprise at least one upper tubular section 28 coaxial with the neck 16, a first inner bearing surface 30 of which would comprise a series of teeth 32 and the second member 26 may comprise at least one lower inner section 34 which would comprise a second outer bearing surface 36 comprising a series of teeth 38 complementary to the teeth 32 of the first bearing surface 30.

The teeth 32, 38 may be arranged on only one angular sector of said bearing surfaces 30, 36 and, in this case, it would be necessary that the series of teeth 32 and 38 be aligned with each other to be able to cooperate together.

However, in the preferred embodiment of the invention, the teeth of the first and second bearing surfaces 30, 36 are an outer bearing surface 30 and an inner bearing surface 36 of the first and second members 24, 26, respectively, and each series of annular teeth 32 or 38 is arranged over the entire periphery of the associated bearing surface 30, 36, namely over 360° about the axis "A" of the cover 22.

Several configurations are possible for univocally determining the axial position of the first inner member 24. In particular, the first inner member 24 may be directly fixed onto the neck 16.

However, in the preferred embodiment of the invention, the device 10 comprises a tubular intermediate member 40 for encasing the neck 16 and the release member 18 which is fixed onto said release member 18.

When the release member 18 is a pump, this member 40 allows in particular to encase the pump.

Thus, in this particular case which is in no way limiting the invention, the release member 18 is shaped in the form of a pump 18 comprising a fastening ring 42 which is crimped onto the neck 16.

The member 40 is also tubular, with a diameter corresponding to that of the ring 42, and it is mounted in a tight fit onto this ring 42.

The intermediate member 40 receives the first inner member 24 in the given axial position. To univocally determine this position, a lower end 41 of the intermediate member 40 is received in axial abutment on the substantially transverse and horizontal upper wall 14, as illustrated by FIG. 2.

Furthermore, to ensure an univocal positioning of the first inner member 24, the tubular intermediate member 40 for encasing the neck 16 comprises at least an outer annular groove 44 and an abutment transverse annular face 46, which is for example formed in particular at the end of said intermediate member 40.

The first inner member 24, meanwhile, comprises at least one lower tubular section 48 coaxial with the neck which comprises at least one inner lug 50 or "rice grain" adapted to be fitted into the outer annular groove 44 of the intermediate member 40.

It is to be noted that the lug 50 may also be replaced by an inner bead, or an angular sector of an inner annular bead, adapted to be fitted into the outer annular groove 44 of the intermediate member.

As illustrated by FIGS. 1 and 2, the first inner member 24 further comprises at least one shoulder inner annular face 52 adapted to be received in abutment on the abutment transverse annular face 46 of the intermediate member 40.

In this configuration, since the position of the first inner member 24 is defined with respect to the intermediate member 40, and the position of the intermediate member 40 is defined with respect to the transverse upper wall 14 of the reservoir 12, it will be understood that the position of the first inner member 24 is therefore univocally defined with respect to the transverse upper wall 14 of the reservoir 12.

According to the invention, the first inner member 24 comprises a transverse wall 54 transversely extending from a lower end 56 of the lower tubular section 48 of said first inner member 24 to the peripheral wall 58 of the second outer member 26. An upper face 62 of the transverse wall 54 forms a stop for at least one axial member 64 which extends radially and inwardly from an inner face 66 of the peripheral wall 58 of the second outer member 26.

Any means known in the art may be suitable for the successful completion of the axial member 64. However, preferably, the inner face 66 of the peripheral wall of the second outer member 26 comprises a plurality of axial ribs 64 angularly distributed in a regular manner over the entire periphery of the inner face 66 of the peripheral wall 58 of the second outer member.

Each rib 64 advantageously comprises an abutment lower face 70, the axial position of which allows, as it is received in abutment on the upper face 62 of the transverse wall 54 of the first inner member 24, to transmit to the second member 26 an axial force reinforcing the engagement of the teeth 32, 38 of the first and second bearing surfaces 30, 36 of the first and second members 24, 26.

It will be noted, among other advantages, that an intermediate ballast member (not shown), preferably annular, may be radially interposed between the lower tubular section 48 of said first inner member 24 and the peripheral wall 58 of the second outer member 26.

According to its manufacturing method, this ballast member may be integrally formed with or fixed onto either one of the inner 24 or outer 26 members.

Furthermore, an upper wall 74 of the second outer member 26 may comprise at least one hole 76 adapted to receive by fitting an insert 78 complementary to said hole, wherein said insert 78 may be fixed in the hole by any means known in the art.

The invention therefore provides a device 10 comprising a clearance compensation cover with a simple and effective design.

SEQUENCE LISTING

Not Applicable

The invention claimed is:

1. A device for packaging and dispensing a liquid or semi-liquid product, comprising:

a release member, an axial reservoir comprising a substantially transverse and horizontal upper wall provided with a neck having received the release member that releases the product from the axial reservoir, and actuating means overlying the release member which is adapted to be acted upon to eject a quantity of the product out from the axial reservoir through the actuating means, a cover which is received on the neck and is located over the release member and the upper wall, wherein the cover comprises at least i) an inner first member which is adapted to be axially and removably received on the neck in a given axial position, and ii) an outer second member comprising a peripheral wall which is fitted onto the first member via a clearance compensation fastening means for allowing, upon an initial mounting of the second outer member onto the first member, an adjustment of the cover with the transverse face of the reservoir with a reduced clearance (J), wherein the first member comprises at least one upper tubular section coaxial with the neck, a first bearing surface the neck comprising a series of teeth axially spaced apart according to a given pitch and wherein the second member comprises at least one lower inner section complementary to the upper tubular section of the first member, which comprises a second bearing surface comprising a series of teeth, axially spaced apart according to the given pitch, which are complementary to the teeth of the first bearing surface and which are adapted to deform to allow the descent of the lower inner section of the second member on the upper tubular section of the first member and the mutual engagement of the teeth of said first and second bearing surfaces when the second member is axially acted upon to fit onto the first member.

2. The device according to claim 1, wherein the first and second bearing surfaces are outer and inner bearing surfaces of the first and second members, respectively, and wherein each series of teeth is a series of annular teeth distributed over the entire periphery of the associated bearing surface.

3. The device according to claim 1, further comprising a tubular intermediate member for encasing the neck and the release member which is fixed onto the release member, and the tubular intermediate member is received in axial abutment on the transverse and horizontal upper wall, and is adapted to receive the first inner member in the given axial position.

4. The device according to claim 3, wherein:

the tubular intermediate member for encasing the neck comprises at least one outer annular groove and an abutment transverse annular face, formed in particular at the end of the intermediate member, the first inner member comprises at least one lower tubular section coaxial with the neck which comprises at least one inner lug and/or an angular sector of an inner annular bead adapted to be fitted into the outer annular groove of the intermediate member and at least one shoulder inner annular face adapted to be received in abutment on the abutment transverse annular face of the first intermediate member.

5. The device according to claim 4, wherein the first inner member comprises a transverse wall transversely extending from a lower end of the lower tubular section of the first inner member to the peripheral wall of the second outer member and an upper face of which forms a stop for at least one axial member extending radially and inwardly from an inner face of the peripheral wall of the second outer member.

6. The device according claim 5, wherein the inner face of the peripheral wall of the first outer member comprises a plurality of axial ribs angularly distributed in a regular manner over the entire periphery of the inner face of the peripheral wall of the second outer member.

7. The device according to claim 5, wherein each rib comprises an abutment lower face, the axial position of the abutment lower face allowing, as the abutment lower face is received in abutment on the upper face of the transverse wall of the first member, to transmit to the second member an axial force reinforcing the engagement of the teeth of the first and second bearing surfaces of the first and second members.

8. The device according to claim 1, wherein an upper wall of the second outer member comprises at least one hole adapted to receive by fitting an insert complementary to said hole.

9. The device according to claim 1, wherein the release member is a pump.

* * * * *